US011168932B2

(12) United States Patent
Schimmele et al.

(10) Patent No.: US 11,168,932 B2
(45) Date of Patent: Nov. 9, 2021

(54) HOUSEHOLD REFRIGERATION APPLIANCE HAVING A CLOSED LOOP SPEED-CONTROLLED FAN AND METHOD FOR OPERATING A HOUSEHOLD REFRIGERATION APPLIANCE HAVING A CLOSED-LOOP SPEED-CONTROLLED FAN

(71) Applicant: BSH HAUSGERAETE GMBH, Munich (DE)

(72) Inventors: Martin Schimmele, Unterschneidheim (DE); Simon Mayer, Dornstadt (DE); Michael Schneider, Haldenwang (DE)

(73) Assignee: BSH Hausgeraete GmbH, Munich (DE)

( * ) Notice: Subject to any disclaimer, the term of this patent is extended or adjusted under 35 U.S.C. 154(b) by 177 days.

(21) Appl. No.: 16/518,086

(22) Filed: Jul. 22, 2019

(65) Prior Publication Data

US 2020/0025432 A1 Jan. 23, 2020

(30) Foreign Application Priority Data

Jul. 20, 2018 (DE) ..... 10 2018 212 127.3

(51) Int. Cl.

| | |
|---|---|
| ***F25D 17/04*** | (2006.01) |
| ***F25D 17/06*** | (2006.01) |
| ***F25D 21/00*** | (2006.01) |
| ***F25D 29/00*** | (2006.01) |

(52) U.S. Cl.

CPC ..... *F25D 17/045* (2013.01); *F25D 17/062* (2013.01); *F25D 21/004* (2013.01); *F25D 29/00* (2013.01); *F25D 2317/067* (2013.01)

(58) Field of Classification Search

CPC ..... F25D 17/045; F25D 17/062; F25D 17/04; F25D 17/06; F25D 21/004; F25D 29/00; F25D 2317/067; F25D 2700/172; F25D 2700/173; F25D 49/00; F25D 2600/111; F25D 2600/112; F25D 2600/06; F25D 21/02

See application file for complete search history.

(56) References Cited

U.S. PATENT DOCUMENTS 5,255,530 A * 10/1993 Janke ..... F25B 49/025 62/180
5,692,385 A * 12/1997 Hollenbeck ..... F25D 21/002 62/140

(Continued)

FOREIGN PATENT DOCUMENTS

JP S58140584 A 8/1983

*Primary Examiner* — Kun Kai Ma

(74) *Attorney, Agent, or Firm* — Laurence A. Greenberg; Werner H. Sterner; Ralph E. Locher

(57) ABSTRACT

A household refrigeration appliance has a thermally-insulated body with an interior container that delimits a coolable interior space, a refrigeration circuit for cooling the coolable interior space and at least one fan. During the proper operation of the household refrigeration appliance, the fan is operated in a closed loop speed-controlled manner according to an at least indirectly specified desired rotational speed of the fan. During an inspection mode, the fan is operated without closed loop speed control, the actual rotational speed of the fan is ascertained and the actual rotational speed is evaluated in order to detect an abnormal operating state of the fan.

12 Claims, 3 Drawing Sheets

(56) References Cited

U.S. PATENT DOCUMENTS

| | | | | |
|---|---|---|---|---|
| 5,790,430 | A * | 8/1998 | Steiert | H05K 7/20209 340/648 |
| 5,962,933 | A * | 10/1999 | Henderson | G06F 11/3058 307/126 |
| 6,824,362 | B2 * | 11/2004 | Dodson, III | F04D 27/004 340/661 |
| 7,701,158 | B2 * | 4/2010 | Wu | F04D 27/008 318/268 |
| 2003/0121275 | A1 * | 7/2003 | Erisgen | A47F 3/0482 62/246 |
| 2006/0199521 | A1 * | 9/2006 | Masuya | F04D 25/08 454/239 |
| 2007/0012055 | A1 * | 1/2007 | Schenk | F25B 49/025 62/208 |
| 2008/0310967 | A1 * | 12/2008 | Franz | G06F 1/20 417/32 |
| 2011/0030396 | A1 | 2/2011 | Marcinkiewicz et al. | |
| 2012/0171050 | A1 * | 7/2012 | Havard, Jr. | F04D 27/004 417/44.1 |
| 2013/0205807 | A1 | 8/2013 | Mcshane et al. | |
| 2015/0160253 | A1 * | 6/2015 | Wang | G06F 1/206 702/145 |
| 2015/0192913 | A1 * | 7/2015 | Vitek | F04D 27/00 700/275 |
| 2018/0094822 | A1 * | 4/2018 | Tada | F24F 11/89 |
| 2020/0309432 | A1 * | 10/2020 | Seo | F25B 49/022 |

* cited by examiner

HOUSEHOLD REFRIGERATION APPLIANCE HAVING A CLOSED LOOP SPEED-CONTROLLED FAN AND METHOD FOR OPERATING A HOUSEHOLD REFRIGERATION APPLIANCE HAVING A CLOSED-LOOP SPEED-CONTROLLED FAN

CROSS-REFERENCE TO RELATED APPLICATION

This application claims the priority, under 35 U.S.C. § 119, of German patent application DE 10 2018 212 127.3, filed Jul. 20, 2018; the prior application is herewith incorporated by reference in its entirety.

BACKGROUND OF THE INVENTION

Field of the Invention

The invention relates to a household refrigeration appliance having a closed loop speed-controlled fan and a method for operating a household refrigeration appliance having a closed loop speed-controlled fan.

Household refrigeration appliances comprise a thermally-insulated body having an interior container that delimits a coolable interior space for storing foodstuffs, and a refrigeration circuit for cooling the coolable interior space. Household refrigeration appliances may also include a closed loop speed-controlled fan. The fan may be subject to abnormal operation.

SUMMARY OF THE INVENTION

It is accordingly an object of the invention to provide a household refrigeration appliance with a closed-loop speed-controlled fan and a method of operating such a household refrigeration appliance, which overcome the a variety of disadvantages associated with the heretofore-known devices and which provide for a possibility to detect an abnormal operating state of the closed loop speed-controlled fan.

With the foregoing and other objects in view there is provided, in accordance with the invention, a method of operating a household refrigeration appliance that comprises a thermally-insulated body with an interior container that delimits an interior space, a refrigeration circuit for cooling the interior space, and at least one fan, The method comprises the following method steps:

during a regular operation of the household refrigeration appliance, operating the fan under closed loop speed control according to a specified desired rotational speed of the fan; and during an inspection mode, operating the fan in without closed loop speed control, ascertaining an actual rotational speed of the fan and evaluating the actual rotational speed with an electronic control unit of the household refrigeration appliance in order to detect an abnormal operating state of the fan.

In other words, the objects of the invention are achieved by a method for operating a household refrigeration appliance that comprises a thermally-insulated body having an interior container that delimits a coolable interior space that is provided for storing foodstuffs, a refrigeration circuit for cooling the coolable interior space and at least one fan, the method including, during the proper operation of the household refrigeration appliance, operating the fan in a closed loop speed-controlled manner according to an at least indirectly specified desired rotational speed of the fan, and during an inspection mode, operating the fan in a manner without closed loop speed control, ascertaining the actual rotational speed of the fan and evaluating the actual rotational speed in particular by means of an electronic control unit of the household refrigeration appliance in order to detect an abnormal operating state of the fan.

The object of the invention is also achieved by way of a household refrigeration appliance that comprises a thermally-insulated body with an interior container that delimits a coolable interior space that is provided for storing foodstuffs, a refrigeration circuit for cooling the coolable interior space and at least one fan, wherein the household refrigeration appliance is configured so as to perform the method according to the invention. The household refrigeration appliance according to the invention is consequently in particular configured so as, during the proper operation of said household refrigeration appliance, to operate the fan in a closed loop speed-controlled manner controlled by means of the electronic control unit, and during an inspection mode to operate the fan in a manner without closed loop speed control, to ascertain the actual rotational speed of the fan, for example by means of a tachometer or signals from its tachometer, and by means of the electronic control unit to evaluate the actual rotational speed in order to detect an abnormal operating state of the fan.

The household refrigeration appliance comprises the thermally-insulated body having the interior container that delimits the coolable interior space that is provided for storing foodstuffs, and the refrigeration circuit. The refrigeration circuit is preferably configured in such a manner that it cools the coolable interior space at least approximately to a specified temperature.

Refrigeration circuits as such are known in principle to the person skilled in the art and comprise in particular an evaporator that is provided to cool the air for the coolable interior space, a compressor and a condenser.

The household refrigeration appliance according to the invention may be for example a household refrigerator. In this case, the coolable interior space is cooled to temperatures greater than 0° C. The household refrigeration appliance according to the invention may however also be a household freezer or a fridge-freezer combination. The household refrigeration appliance according to the invention may comprise precisely one coolable interior space but may also comprise multiple coolable interior spaces.

The household refrigeration appliance according to the invention may also be configured as a wine refrigerator that is provided to store bottles that are filled with a drinkable fluid, in particular wine.

The household refrigeration appliance may comprise a duct system that runs for example within the thermally-insulated body and is connected in particular via an opening to the coolable interior space. The evaporator and the fan are arranged in the duct system with the result that the fan tends to convey air that is cooled by the evaporator into the coolable interior space.

The fan comprises in particular an electric motor and a rotatably mounted fan wheel that may be set into rotation by means of the motor.

The speed of the fan is controlled in a closed loop manner, in other words the household refrigeration appliance comprises a feedback control for the closed loop speed control of the fan with the result that the fan or rather its fan wheel rotates in a closed loop speed-controlled manner during the proper operation at a specified rotational speed.

During the proper operation of the household refrigeration appliance, it is possible for the evaporator to ice up, in that in particular ice is formed on its surface. In order in particular to remove the ice, it is possible to provide for de-icing the evaporator in particular in a manner controlled by means of the electronic control unit, in that said evaporator is warmed for example by means of a heating device that may be controlled by the electronic control unit. In accordance with one embodiment of the method according to the invention or rather of the household refrigeration appliance according to the invention, the abnormal operating state of the fan is an icing-up of the evaporator that is arranged in the duct system.

The household refrigeration appliance is in particular configured so as in the inspection mode to detect the abnormal operating state of the fan, in particular a potential icing-up of the evaporator, by means of evaluating the actual rotational speed of the fan. In order to ascertain the actual rotational speed, the fan comprises for example a tachometer that is connected to the electronic control unit.

The abnormal operating state of the fan may also be a failure of the fan.

The fan may be provided so as to convey air that is warmed by the condenser into the environment of the household refrigeration appliance. It is then possible to provide that, on the basis of the detected failure of this fan, the compressor is operated in a gentle operating mode controlled by means of the electronic control unit. The compressor is for example a closed loop speed-controlled compressor. A gentle operating mode is for example an operation of the compressor at a lower rotational speed.

The condenser may become contaminated during operation. A contaminated condenser may be an abnormal operating state of the fan that is arranged in the condenser. In particular, if the condenser is configured as a roll or lamella condenser, this may impair the operation of the fan that is arranged in the condenser and this may be detected by means of evaluating the actual rotational speed of the fan during the inspection mode. In the event that it is detected that the condenser is contaminated, it is then possible to provide for operating the condenser in a gentle operating mode controlled by means of the electronic control unit.

It is also possible by means of evaluating the actual rotational speed of the fan to detect a function of the fan during the inspection mode.

The fan may experience a change in its load as a result of external or internal influences which may have an effect on its rotational speed when operating in a manner without closed loop speed control (inspection mode). For example, a malfunction of the fan or preferably an icing-up of the evaporator is detected by way of example by virtue of a change in the detected rotational speed. It is also possible to detect the status of the fan itself in order for example to energetically optimize the device behavior with the aid of this information. Consequently, it is possible using a rotational speed measurement of the fan to conclude the state of the fan while the household refrigeration appliance is in the inspection mode. It is thus possible to detect a change in the state of the household refrigeration appliance, for example an icing-up of the evaporator or damage to the fan. The fan may as a consequence be considered in particular in parallel to its fan function as a sensing unit.

An icing-up of the evaporator causes in particular a change in the flow behavior of the duct system and thus a change in the load of the fan. If the fan is operated in a closed loop speed-controlled manner, then it is operated at the desired rotational speed essentially independently of the load of the fan. According to the invention, the fan is therefore operated in a manner without closed loop speed control in the inspection mode, in other words the closed loop speed control of the fan is deactivated during the inspection mode.

Consequently, when the fan is operated in a manner without closed loop speed control in the inspection mode, a change in the load of the fan for example as a result of the evaporator icing-up influences its actual rotational speed, as a result of which it is possible by means of evaluating the actual rotational speed during the inspection mode to conclude in particular that the evaporator has iced up.

The household refrigeration appliance may preferably comprise an inverter that has pulse-width modulation and is provided so as to control the fan. The inverter is operated in particular during the inspection mode with a predetermined duty cycle that is allocated to the inspection mode.

A feedback control that is required for the closed loop speed control may be realized for example by means of the electronic control unit that then for example directly controls the inverter.

The household refrigeration appliance may preferably comprise a closed loop controller that is controlled by the electronic control unit and is provided so as to control the inverter and to operate the fan in a closed loop speed-controlled manner. Consequently, it is possible for example to combine the fan, the inverter and the closed loop controller into one assembly. The electronic control unit provides in this case information for example to the closed loop controller as to whether the fan is to be operated in the closed loop speed-controlled operation or for the inspection mode is to be operated in the operation without closed loop speed control.

In the closed loop speed-controlled operation, it is also possible to provide for the fan to be operated at different rotational speeds.

It may preferably be provided by means of the electronic control unit specifying to the closed loop controller the predetermined duty cycle that is allocated to the inspection mode to deactivate the closed loop speed control of the fan that may be performed by the closed loop controller so that the fan is controlled by the inverter in a manner without closed loop speed control during the inspection mode. Consequently, the closed loop controller that is configured for example as a microcontroller is configured in particular in such a manner that it deactivates the closed loop controller for the predetermined duty cycle that is allocated to the inspection mode in order to operate the fan in an uncontrolled manner, in other words in a manner without closed loop speed control.

The inspection mode may prevail for example for a specified time period.

In accordance with an added feature of the invention, the fan may be operated in a closed loop speed-controlled manner prior to and/or after the inspection mode.

It may also be provided that directly after starting up the fan from standstill said fan is initially operated in a manner without closed loop speed control for a predetermined time period in the inspection mode and after the end of the predetermined time period is operated in a closed loop speed-controlled manner. Where appropriate, it is also possible directly prior to the inspection mode to perform a start-up phase of the fan from standstill, this phase being performed in a manner without closed loop speed control or in a closed loop speed-controlled manner.

The actual rotational speed may be evaluated during the inspection mode for example by means of comparing the actual rotational speed with a rotational speed of the fan that is to be expected for a normal operating state of the fan, in particular for an evaporator that is not iced-up.

On the basis of the evaluated actual rotational speed of the fan during the inspection mode, it is possible to initiate a procedure of de-icing the evaporator, in that for example the electronic control unit switches on a heating device so as to de-ice the evaporator after the prevailing cooling phase.

It is possible owing to the iced-up evaporator that the load of the fan reduces. The procedure of de-icing the evaporator is then initiated for example if the actual rotational speed exceeds a predetermined threshold value during the inspection mode.

Based on the method according to the invention or rather on the household refrigeration appliance according to the invention, it is possible to detect the function and the state of the fan for example via a tachometer signal despite an internal closed loop speed control of the fan.

This is achieved in particular by means of deactivating the closed loop speed control function for example in the case of a predetermined duty cycle or for a specific time after the start-up of the fan, as a result of which the load for a fan is detected despite the possibility of a closed loop speed control function via the tachometer signal.

A change in the load of the fan may be a result of different causes. Examples of such causes are air with a high moisture content or an icing-up of the evaporator which result in a change in the cross section of the duct system.

By virtue of detecting the load on the fan, it is possible for example to improve the control of the household refrigeration appliance, (by way of example: initiating a defrosting phase or rather initiating a procedure of de-icing the evaporator).

Other features which are considered as characteristic for the invention are set forth in the appended claims.

Although the invention is illustrated and described herein as embodied in a household refrigeration appliance having a closed loop speed-controlled fan and method for operating a household refrigeration appliance having a closed-loop speed-controlled fan, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
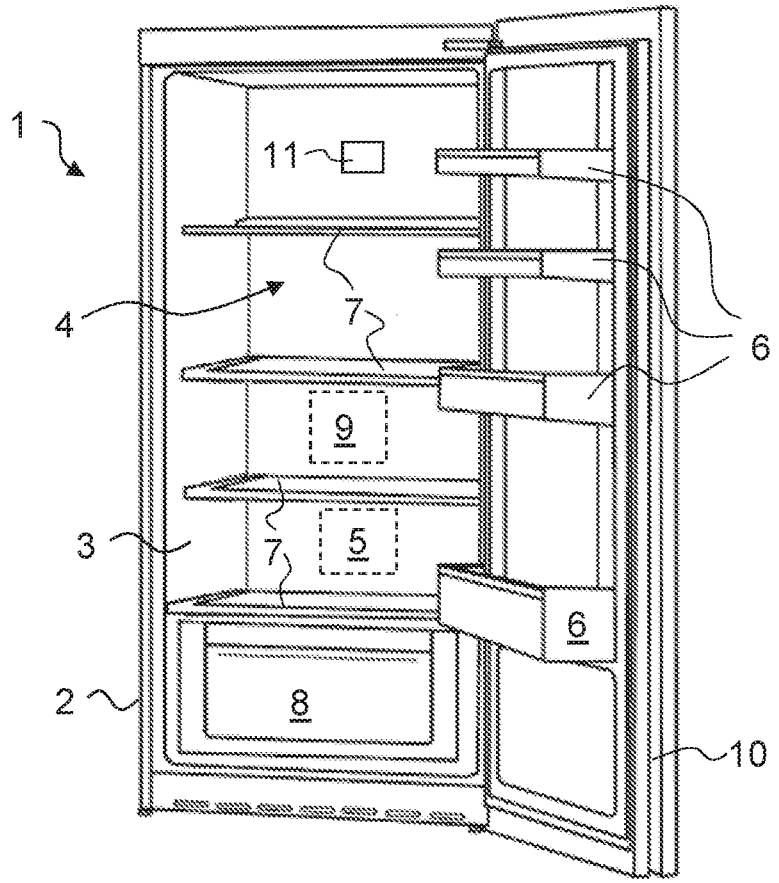
FIG. 1 is a perspective view of a household refrigeration appliance.

Referring now to the figures of the drawing in detail and first, particularly, to FIG. 1 thereof, there is shown a perspective view of a household refrigeration appliance 1 that comprises a thermally-insulated body 2, also referred to as a housing or a carcass, with an interior container 3 that delimits a coolable interior space 4. The coolable interior space 4 is provided for storing foodstuffs.

The household refrigeration appliance 1 comprises in the case of the present exemplary embodiment a door leaf 10 that is mounted on the body 2 in such a manner as to be able to pivot in particular with respect to a vertically extending axis. The coolable interior space 4 is accessible when the door leaf 10 is in the open state and the coolable interior space 4 is closed when the door leaf 10 is in the closed state.

In the case of the present exemplary embodiment, multiple door trays 6 for storing foodstuffs are arranged on the side of the door leaf 10 that is facing the direction of the coolable interior space 4. In particular multiple compartment trays 7 for storing foodstuffs are arranged in the coolable interior space 4. A drawer 8 is arranged in the lower region of the coolable interior space 4. The drawer is likewise used for storing food. One of the compartment trays 7 that covers the upwardly positioned opening of the drawer 8 is arranged above the drawer 8.

Figure 2:
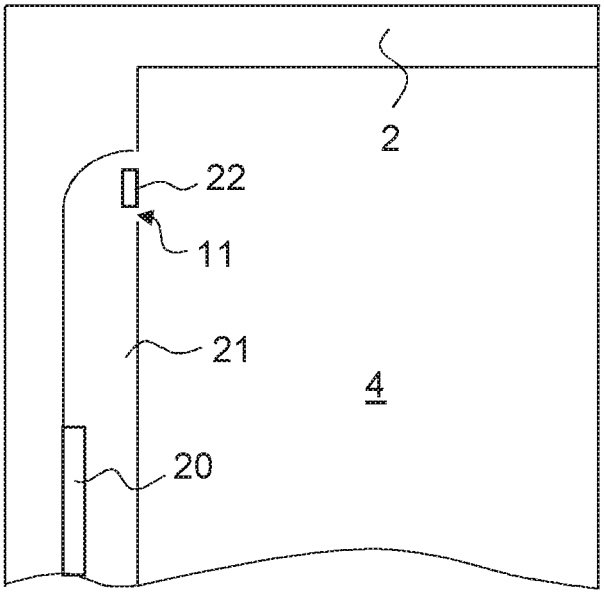
FIG. 2 is a partial view of a duct system of the household refrigeration appliance.

The household refrigeration appliance 1 comprises a refrigeration circuit 5 that is known in principle to those of skill in the art, for cooling the coolable interior space 4. With reference to FIG. 2, the refrigeration circuit 5 comprises inter alia an evaporator 20.

The household refrigeration appliance 1 comprises in the case of the present exemplary embodiment an electronic control unit 9 that is configured so as to control the refrigeration circuit 5 such that the coolable interior space 4 assumes at least approximately a specified desired temperature or a desired temperature that may be specified. The electronic control unit 9 is preferably configured in such a manner that it controls the temperature of the coolable interior space 4 in a closed-loop manner. In order where appropriate to obtain the actual temperature of the coolable interior space 4, the household refrigeration appliance 1 may comprise at least one temperature sensor (not illustrated in detail) connected to the electronic control unit 9.

With reference to FIG. 2, the household refrigeration appliance 1 comprises a duct system 21 that is arranged in particular within the thermally-insulated body 2 and is connected to the coolable interior space 4 via an opening 11. The evaporator 20 is arranged in the duct system 21.

A fan 22 is arranged in the duct system 21. The fan 22 is provided, in its activated state, to convey air that is cooled by the evaporator 20 into the coolable interior space 4 via the duct system 21 and via the opening 11.

Figure 3:
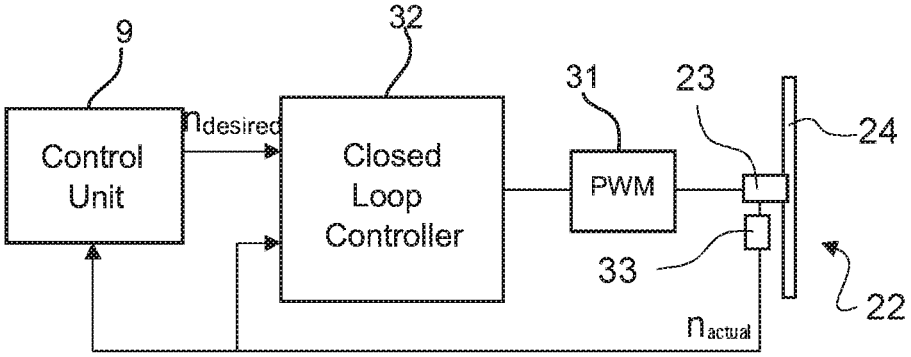
FIG. 3 is a partly schematic view of a closed loop speed-controlled fan of the household refrigeration appliance.

The fan 22 comprises an electric motor 23 and a fan wheel 24 that may be rotated by means of the motor 23 (FIG. 3).

The household refrigeration appliance 1 is configured so as, during the proper operation of said household refrigeration appliance, to operate the fan 22 in a closed loop speed-controlled manner according to a desired rotational speed $n_{desired}$ that is specified at least indirectly by the electronic control unit 9, and during an inspection mode to operate the fan in a manner without closed loop speed control, to ascertain the actual rotational speed $n_{actual}$ of the fan 22 and to evaluate the actual rotational speed by means of the electronic control unit 9 in order to detect an abnormal operating state of the fan 22, in particular to detect an icing-up of the evaporator 20.

In order to determine the actual rotational speed $n_{actual}$ of the fan 22, the household refrigeration appliance 1 comprises in the case of the present exemplary embodiment a tachometer 33 that measures the actual rotational speed $n_{actual}$ of the fan 22 or rather of its fan wheel 24. The output signal of the tachometer 33 that comprises information relating to the actual rotational speed is supplied inter alia for evaluating purposes to the electronic control device 9.

The household refrigeration appliance 1 comprises in the case of the present exemplary embodiment an inverter 31 that has pulse-width modulation and is provided so as to control the fan 22. The inverter 31 is operated in particular during the inspection mode with a predetermined duty cycle that is allocated to the inspection mode.

In the exemplary embodiment, the household refrigeration appliance 1 comprises a closed loop controller 32 that is controlled by the electronic control unit 9 and is provided so as control the inverter 31 and to operate the fan 22 in a closed loop speed-controlled manner. The electronic control unit 9 supplies for example to the closed loop controller 32 information as to whether the fan 22 is to be operated in the closed loop speed-controlled operation or for the inspection mode is to be operated in the operation without closed loop speed control and information relating to the desired rotational speed $n_{desired}$ of the fan 22.

In the case of the present exemplary embodiment, the actual rotational speed $n_{actual}$ is evaluated during the inspection mode by comparing the actual rotational speed with a rotational speed of the fan 22 that is to be expected for the evaporator 20 that has not iced-up and/or for a fan 22 that is not defective in general for a normal operating state of the fan 22. On the basis of the evaluated actual rotational speed of the fan 22 during the inspection mode, it is possible to initiate a procedure of de-icing the evaporator 20, in that for example the electronic control unit 9 switches on a heating device so as to de-ice the evaporator after the prevailing cooling phase. The procedure of de-icing the evaporator 20 may then be initiated for example if the actual rotational speed exceeds a specified threshold value during the inspection mode.

Figure 4:
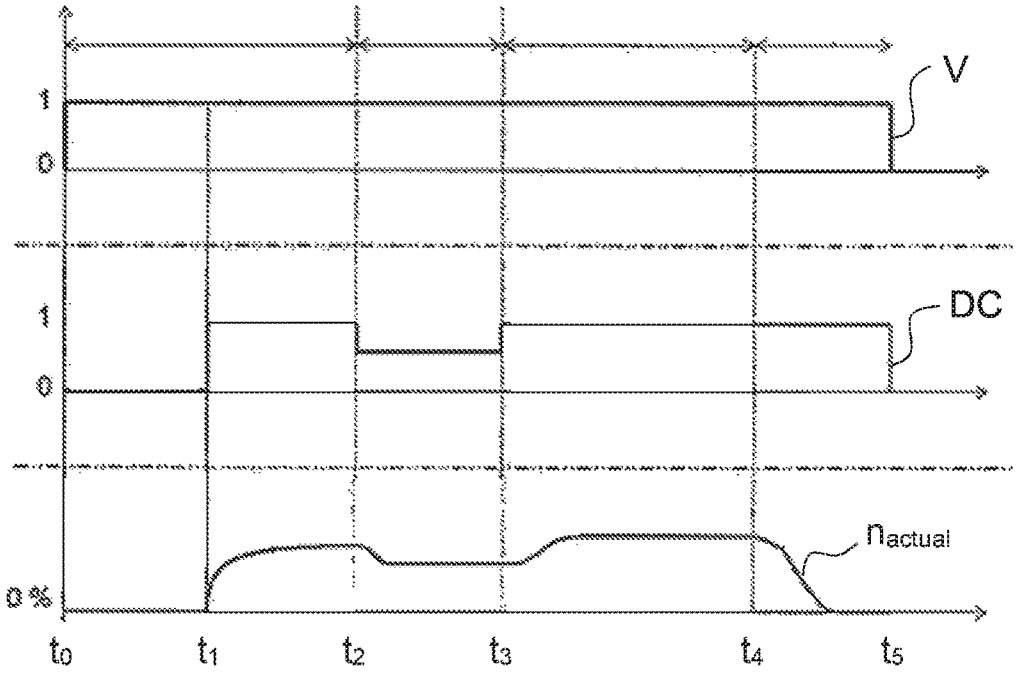
FIG. 4 is a timing diagram that illustrates the operation of the fan.

In accordance with an embodiment illustrated in FIG. 4, it is provided by means of the electronic control unit 9 specifying to the closed loop controller 32 the predetermined duty cycle DC that is allocated to the inspection mode to deactivate the closed loop speed control of the fan that may be performed by the closed loop controller 32 so that the fan 22 is controlled by the inverter 31 in a manner without closed loop speed control during the inspection mode. The prevailing duty cycle DC of the inverter 31 is then the predetermined duty cycle that is allocated to the inspection mode. For the closed loop speed-controlled operation of the fan 22 in the case of the present exemplary embodiment, the electronic control unit 9 supplies to the closed loop controller 32 a different duty cycle to the predetermined duty cycle that is allocated to the inspection mode, said different duty cycle comprising information relating to the desired rotational speed of the fan 22 during the closed loop speed-controlled operation.

Referring now to FIG. 4, in the case of this exemplary embodiment, a supply voltage V is switched on for the inverter 31 at the point in time $t_0$.

From the point in time $t_1$ to the point in time $t_2$, the fan 22 is started up from standstill during a start-up phase. During this start-up phase, the fan 22 may be operated in a closed loop speed-controlled manner or in a manner without closed loop speed control.

From the point in time $t_2$ onwards, the electronic control unit 9 supplies to the closed loop controller 32 the predetermined duty cycle that is allocated to the inspection mode, said duty cycle being for example 50%. Subsequently, the closed loop controller 32 or the closed loop function of the closed loop control is deactivated with the result that the fan 22 is operated in a manner without closed loop speed control.

As long as the predetermined duty cycle that is allocated to the inspection mode is available at the closed loop controller 32, the rotational speed of the fan 22 is not controlled in a closed loop manner and after a relatively short settling time period may be compared with the desired rotational speed that is allocated to the evaporator 20 that is not iced-up. If the analysis of the actual rotational speed and consequently of the fan 22 is completed at the point in time t3, the electronic control unit 9 transmits to the closed loop controller 32 a duty cycle DC that differs from the predetermined duty cycle that is allocated to the inspection mode, as a result of which the fan 22 is operated in a closed loop speed-controlled manner at a rotational speed that is allocated to the selected duty cycle.

At the point in time $t_4$ in the case of the present exemplary embodiment, the duty cycle is set to 0% in order to slow the fan 22 down to standstill. The supply voltage V of the inverter is switched off at the point in time $t_5$.

Figure 5:
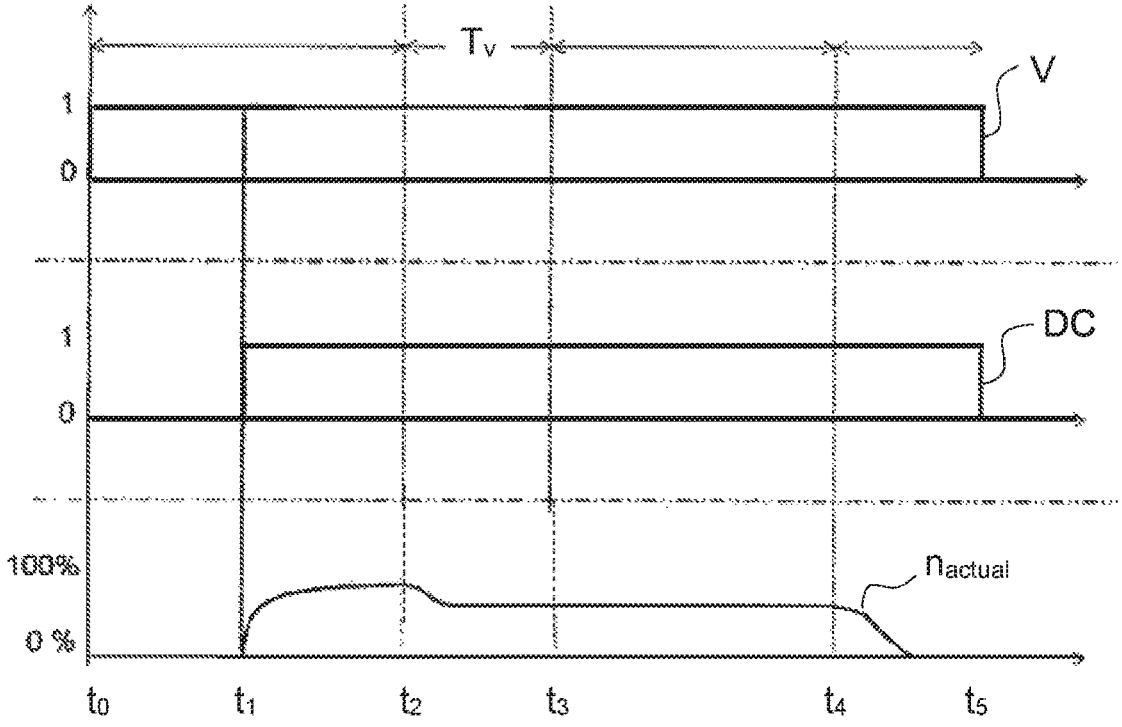
FIG. 5 is a similar diagram that illustrates the operation of the fan.

In accordance with an embodiment illustrated in FIG. 5, it is provided that directly after the fan 22 has been started up from standstill, the fan 22 is operated initially for a predetermined period of time $T_v$ in the inspection mode in a manner without closed loop speed control and after the end of the predetermined time period $T_v$ said fan is operated in a closed loop speed-controlled manner. Where appropriate, it is also possible to provide a start-up phase of the fan 22 from standstill directly prior to the inspection mode, the start-up phase being performed in a manner without closed loop speed control or in a closed loop speed-controlled manner.

At the point in time $t_0$ in the case of this exemplary embodiment, the supply voltage V for the inverter 31 is switched on.

At the point in time $t_1$, the start-up phase of the fan 22 commences and ends at the point in time $t_2$. The duration of the start-up phase may be for example fixedly specified or may end upon a predetermined actual rotational speed of the fan 22 being achieved.

At the point in time $t_2$, the start-up phase ends and the inspection mode commences automatically for the predetermined time period $T_v$ that ends at the point in time $t_3$. The closed loop speed control function is deactivated during the inspection mode with the result that after a settling time period the actual rotational speed of the fan 22 is compared with its desired rotational speed. After the specified time period Tv, the analysis of the actual rotational speed $n_{actual}$ and consequently of the fan 22 is completed and the closed loop speed-control function re-activated at the point in time t3.

At the point in time $t_4$ in the case of the present exemplary embodiment, the desired rotational speed is set to 0 in order for example to slow the fan 22 down in a closed loop speed-controlled manner to standstill. The supply voltage V of the inverter is switched off at the point in time $t_5$.

Figure 6:
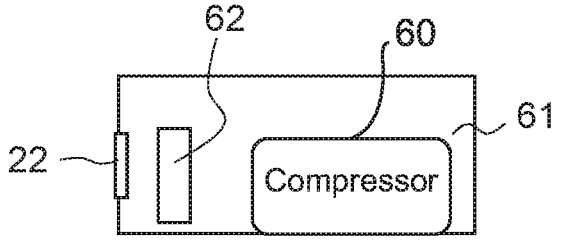
FIG. 6 is a schematic illustration of a compressor of a refrigeration circuit of the household refrigeration appliance.

The refrigeration circuit of the household refrigeration appliance 1 comprises a compressor 60 that is illustrated in FIG. 6 and a condenser 62, that are arranged for example in a machine space 61 that is located to the rear of the drawer 8.

The abnormal operating state of the fan 22 may also be a failure of the fan 22.

The fan 22 may be provided for example so as to convey air that is warmed by the condenser 62 into the environment of the household refrigeration appliance 1. It is then possible to provide that on the basis of a detected failure of this fan 22 the compressor 60 is operated in a gentle operating mode. The compressor 60 is for example a closed loop speed-controlled compressor. A gentle operating mode, by way of example, is an operation of the compressor 60 at a lower rotational speed.

The condenser that is configured in particular as a roll or lamella condenser may become contaminated, for example during operation. It is possible to detect this in the case of the present exemplary embodiment by evaluating the actual rotational speed of the fan 22 during the inspection mode. In the case of a detected contamination of the condenser, it may then be provided to operate the compressor 60 in the gentle operating mode controlled by means of the electronic control unit 9.

The following is a summary list of reference numerals and the corresponding structure used in the above description of the invention:

1 Household refrigeration appliance
2 Body, housing
3 Interior container
4 Coolable interior space
5 Refrigeration circuit
6 Door tray
7 Compartment trays
8 Drawer
9 Electronic control unit
10 Door leaf
11 Opening
20 Evaporator
21 Duct system
22 Fan
23 Motor
24 Fan
31 Inverter
32 Closed loop controller
33 Tachometer
60 Compressor
61 Machine space
62 Condenser
$n_{actual}$ Actual rotational speed
$n_{desired}$ Desired rotational speed
DC Duty Cycle
Tv Predetermined time period
V Supply voltage
$t_1$-$t_5$ Point in time

The invention claimed is:

1. A method of operating a household refrigeration appliance that comprises a thermally-insulated body having an interior container that delimits an interior space, a refrigeration circuit for cooling the interior space, at least one fan, and an inverter operable with pulse-width modulation for controlling the fan, the method comprising the following method steps:

during a regular operation of the household refrigeration appliance, operating the fan under closed loop speed control according to a specified desired rotational speed of the fan;

during an inspection mode, operating the fan without closed loop speed control, ascertaining an actual rotational speed of the fan and evaluating the actual rotational speed with an electronic control unit of the household refrigeration appliance in order to detect an abnormal operating state of the fan; and operating the inverter during the inspection mode with a predetermined duty cycle that is allocated to the inspection mode.

2. The method according to claim 1, which comprises evaluating the actual rotational speed by comparing the actual rotational speed with a rotational speed of the fan to be expected for a normal operating state of the fan.

3. The method according to claim 1, wherein the refrigeration circuit comprises a compressor and a condenser, and the fan is provided to convey air that is warmed by the condenser into an environment of the household refrigeration appliance, and the abnormal operating state represents a contamination of the condenser and/or a failure of the fan, and the method comprises:

detecting a contamination of the condenser and/or detecting a failure of the fan based on an evaluation of the actual rotational speed of the fan during the inspection mode; and based on the detected contamination of the condenser and/or based on the failure of the fan, operating the compressor in a gentle operating mode.

4. A household refrigeration appliance, comprising:

a thermally-insulated body having an interior container that delimits a coolable interior space for storing foodstuffs;

a refrigeration circuit for cooling the coolable interior space; and at least one fan; and wherein the household refrigeration appliance is configured to carry out the method according to claim 1.

5. A method of operating a household refrigeration appliance that comprises a thermally-insulated body having an interior container that delimits an interior space, a refrigeration circuit for cooling the interior space, and at least one fan, the method comprising the following method steps:

during a regular operation of the household refrigeration appliance, operating the fan under closed loop speed control according to a specified desired rotational speed of the fan;

during an inspection mode, operating the fan without closed loop speed control, ascertaining an actual rotational speed of the fan and evaluating the actual rotational speed with an electronic control unit of the household refrigeration appliance in order to detect an abnormal operating state of the fan; and operating the fan in the inspection mode for a predetermined period of time directly after starting up the fan from standstill and after an end of the predetermined time period operating the fan under closed loop speed control.

6. The method according to claim 5, which comprises starting up the fan from standstill during a start-up phase of the fan, and carrying out the start-up phase immediately prior to the inspection mode.

7. The method according to claim 5, wherein the household refrigeration appliance comprises an inverter operable with pulse-width modulation for controlling the fan, and the method further comprises operating the inverter during the inspection mode with a predetermined duty cycle that is allocated to the inspection mode.

8. The method according to claim 7, which comprises providing a closed loop controller to be controlled by the electronic control unit and configured to control the inverter and to operate the fan under closed loop speed control.

9. The method according to claim 8, which comprises causing the electronic control unit to specify to the closed loop controller the predetermined duty cycle that is allocated to the inspection mode, and deactivating the closed loop speed control of the fan that may be performed by the closed loop controller so that the fan is controlled by the inverter without closed loop speed control during the inspection mode.

10. A method of operating a household refrigeration appliance that comprises a thermally-insulated body having an interior container that delimits an interior space, a refrigeration circuit for cooling the interior space, at least one fan, and a duct system in which an evaporator of the refrigeration circuit and the fan are arranged and which is connected to the interior space, the method comprising the following method steps:

during a regular operation of the household refrigeration appliance, operating the fan under closed loop speed control according to a specified desired rotational speed of the fan;

during an inspection mode, operating the fan without closed loop speed control, ascertaining an actual rotational speed of the fan and evaluating the actual rotational speed with an electronic control unit of the household refrigeration appliance in order to detect an abnormal operating state of the fan; and causing the fan to convey air that is cooled by the evaporator from the duct system into the interior space and wherein the abnormal operating state of the fan represents an icing up of the evaporator.

11. The method according to claim 10, which comprises evaluating the actual rotational speed by comparing the actual rotational speed with a rotational speed of the fan that is to be expected for an evaporator that is not iced up and/or initiating a procedure of de-icing the evaporator on the basis of the evaluated actual rotational speed of the fan during the inspection mode.

12. The method according to claim 11, which comprises initiating the de-icing procedure if, during the inspection mode, the actual rotational speed exceeds a specified threshold value.

* * * * *